US010801302B2

(12) United States Patent
Yang et al.

(10) Patent No.: US 10,801,302 B2
(45) Date of Patent: Oct. 13, 2020

(54) INNER START-UP TOOL OF CONDUIT BEARING CAPACITY REINFORCING DEVICE

(71) Applicant: China University of Petroleum—Beijing, Beijing (CN)

(72) Inventors: Jin Yang, Beijing (CN); Qishuai Yin, Beijing (CN); Shanshan Shi, Beijing (CN)

(73) Assignee: China University of Petroleum-Beijing, Beijing (CN)

( * ) Notice: Subject to any disclaimer, the term of this patent is extended or adjusted under 35 U.S.C. 154(b) by 0 days.

(21) Appl. No.: 16/533,468

(22) Filed: Aug. 6, 2019

(65) Prior Publication Data

US 2020/0165897 A1 May 28, 2020

(30) Foreign Application Priority Data

Nov. 26, 2018 (CN) ..... 2018 1 1414856

(51) Int. Cl.
*E21B 34/00* (2006.01)
*E21B 17/01* (2006.01)

(52) U.S. Cl.
CPC ..... *E21B 34/00* (2013.01); *E21B 17/01* (2013.01)

(58) Field of Classification Search
CPC ..... E21B 34/00; E21B 17/01
See application file for complete search history.

(56) References Cited

U.S. PATENT DOCUMENTS 4,972,907 A 11/1990 Sellars, Jr.
2004/0251029 A1 12/2004 Horton, III
2016/0333641 A1 11/2016 Ellison

FOREIGN PATENT DOCUMENTS

CN 101581216 A 11/2009
CN 103132597 A 6/2013
(Continued)

OTHER PUBLICATIONS

Spiral welded pipe is used to improve steel plate storage support, Cement Guide for New Epoch, No. 3, 2013.
(Continued)

*Primary Examiner* — James G Sayre
(74) *Attorney, Agent, or Firm* — Young Basile Hanlon & MacFarlane, P.C.

(57) ABSTRACT

The present invention provides an inner start-up tool of a conduit bearing capacity reinforcing device and a using method thereof, the inner start-up tool comprising: an outer cylinder in which a pressure bearing disc is axially movably provided, a lower end of the pressure bearing disc being elastically connected with a balance block, and a first ring block and a second ring block being movably diametrically disposed through a lower cylinder walls of the outer cylinder; a first link mechanism having a first vertical rod and a first horizontal rod rotatably connected to the first vertical rod, the first vertical rod being rotatably connected to the balance block, the first horizontal rod being rotatably connected to the first ring block; a second link mechanism having a second vertical rod and a second horizontal rod rotatably connected to the second vertical rod, the second vertical rod being rotatably connected to the balance block, the second horizontal rod being rotatably connected to the second ring block. The inner start-up tool of the conduit bearing capacity reinforcing device and the using method thereof according to the present invention can be used for efficiently operating the conduit bearing capacity reinforcing device, is simple in structure and convenient in use.

8 Claims, 4 Drawing Sheets

(56) References Cited

FOREIGN PATENT DOCUMENTS

| | | | |
|---|---|---|---|
| CN | 105780802 | A | 7/2016 |
| CN | 105780806 | A | 7/2016 |
| CN | 106639896 | A | 5/2017 |
| CN | 107859504 | A | 3/2018 |
| CN | 108661568 | A | 10/2018 |

OTHER PUBLICATIONS

The Test Study on the Loading Transfer Mechanism of Model Piles With Branches and Plates, Apr. 20, 2009.
Analysis of bearing capacity of water barrier basket in panyu 34-1 gas field, 1994-2018 China Academic Journal Electronic Publishing House, http://cnki.net.
Chinese Search Report, dated Nov. 8, 2018.
Special PCT Search Report, dated Mar. 29, 2019.

INNER START-UP TOOL OF CONDUIT BEARING CAPACITY REINFORCING DEVICE

TECHNICAL FIELD

The invention relates to the technical field of offshore oil and gas drilling and completion, and in particular to an inner start-up tool of a conduit bearing capacity reinforcing device and a using method thereof.

BACKGROUND ART

As China increases the efforts in the oil and gas exploration and development, the oil and gas exploration regions gradually turn from the land to the offshore shallow and deep water regions, which are also the regional focuses for the future oil and gas development.

The drilling and completion, and production operations in the offshore shallow water region cannot be performed without a water separation and a support to the surface blowout preventer (BOP) or the Christmas tree by a riser; while the drilling and completion, and production operations in the offshore deep water region cannot be performed without a support to the subsea blowout preventer (BOP) or the Christmas tree by a surface conduit. The bearing capacity of the riser or the surface conduit for the upper blowout preventer (BOP) or the Christmas tree mainly comes from a resistance between a side face of an outer wall of the conduit and the seabed soil and a resistance between an end face of a bottom of the conduit and the seabed soil. The magnitude of the bearing capacity is related to an area of action between the conduit and the seabed soil, i.e., the bearing capacity increases as a driving depth, and/or a diameter and a wall thickness, of the conduit increase.

However, due to the technical and cost constraints, it is usually impossible to set the conduit too deep, which leads to a phenomenon that the conduit often sinks sharply due to insufficient bearing capacity during the subsequent operation. As a result, the drilling and completion, and production operations cannot be carried out normally, while causing a large amount of economic losses and even a marine ecological environment pollution.

Therefore, the bearing capacity of the riser or the surface conduit is the key in the drilling and completion, and production operations of the offshore oil and gas fields, and it influences the operation progress and success of a well.

SUMMARY OF THE INVENTION

The object of the present invention is to provide an inner start-up tool of a conduit bearing capacity reinforcing device and a using method thereof, which can be used for efficiently operating the conduit bearing capacity reinforcing device, is simple in structure and convenient in use.

The above object of the present invention can be achieved by adopting the following technical solutions:

The invention provides an inner start-up tool of a conduit bearing capacity reinforcing device, comprising:

an outer cylinder in which a pressure bearing disc is axially movably provided, a lower end of the pressure bearing disc being elastically connected to a balance block, and a first ring block and a second ring block being movably diametrically disposed through a lower cylinder wall of the outer cylinder;

a first link mechanism having a first vertical rod and a first horizontal rod rotatably connected to the first vertical rod, the first vertical rod being rotatably connected to the balance block, the first horizontal rod being rotatably connected to the first ring block; and a second link mechanism having a second vertical rod and a second horizontal rod rotatably connected to the second vertical rod, the second vertical rod being rotatably connected to the balance block, the second horizontal rod being rotatably connected to the second ring block.

The present invention also provides a using method of an inner start-up tool, using the inner start-up tool of a conduit bearing capacity reinforcing device as described above, comprising the steps of:

a step S1 of seating the inner start-up tool of the conduit bearing capacity reinforcing device on a platform surface and connecting the inner start-up tool to a drilling column to form a tool string;

a step S2 of lowering the tool string to a designed depth, thereafter opening pump circulation to fill the tool string with seawater, wherein under the pressure of the seawater, the pressure bearing disc moves downwards, the first ring block and the second ring block extend radially outward from the outer cylinder under the action of the first link mechanism and the second link mechanism;

a step S3 of lifting or rotating the tool string such that the first ring block and the second ring block of the tool string are aligned with a plurality of keyways on a circular ring of the conduit bearing capacity reinforcing device; and a step S4 of gently lifting or lowering the drill column, and if the lifting or lowering is obstructed, it can be confirmed that the inner start-up tool of the conduit bearing capacity reinforcing device has been mated with the conduit bearing capacity reinforcing device, otherwise, continuing to fine-tune a position of the inner start-up tool of the conduit bearing capacity reinforcing device until the inner start-up tool of the conduit bearing capacity reinforcing device is successfully mated with the conduit bearing capacity reinforcing device.

The characteristics and advantages of the inner start-up tool of the conduit bearing capacity reinforcing device and the using method thereof according to the present invention are as follows: the inner start-up tool of the conduit bearing capacity reinforcing device according to the invention can be repeatedly use for many times, is simple in structure, is low in cost and is easy to use; in addition, the invention is convenient to operate, has high reliability, can be lowered and lifted rapidly and conveniently, without difficulty in being lowered or lifted.

DETAILED DESCRIPTION OF THE PREFERRED EMBODIMENTS

Hereinafter the technical solution in the embodiments of the present invention will be described clearly and integrally in combination with the accompanying drawings in the embodiments of the present invention, and obviously the described embodiments are merely part of the embodiments, not all of the embodiments. Based on the embodiments of the present invention, all other embodiments that are obtained by persons skilled in the art without making creative efforts fall within the protection scope of the present invention.

Embodiment 1

Figure 1:
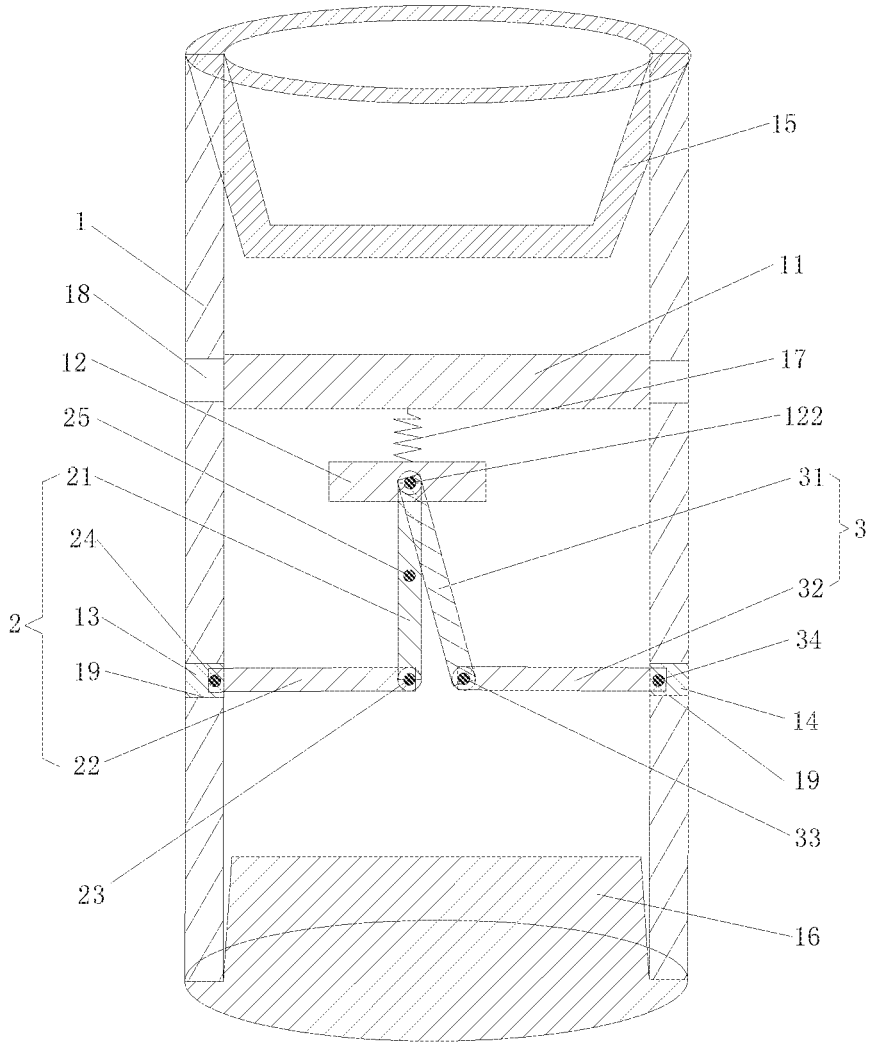
FIG. 1 is a structural schematic of an inner start-up tool of a conduit bearing capacity reinforcing device according to the present invention.

As shown in FIG. 1, the present invention provides an inner start-up tool of a conduit bearing capacity reinforcing device, comprising: an outer cylinder 1, a first link mechanism 2 and a second link mechanism 3, wherein a pressure bearing disc 11 is axially movably provided in the outer cylinder 1, a lower end of the pressure bearing disc 11 is elastically connected to a balance block 12, and a first ring block 13 and a second ring block 14 are movably diametrically disposed through a lower cylinder wall of the outer cylinder 1, respectively; the first link mechanism 2 has a first vertical rod 21 and a first horizontal rod 22 rotatably connected to the first vertical rod 21, the first vertical rod 21 is rotatably connected to the balance block 12, the first horizontal rod 22 is rotatably connected to the first ring block 13; the second link mechanism 3 has a second vertical rod 31 and a second horizontal rod 32 rotatably connected to the second vertical rod 31, the second vertical rod 31 is rotatably connected to the balance block 12, the second horizontal rod 32 is rotatably connected to the second ring block 14.

In order to solve the problem that wellhead sinking caused by an insufficient bearing capacity of the riser affects operation safety and time effect, the present invention designs an inner start-up tool capable of operating a conduit bearing capacity reinforcing device, to rapidly and conveniently operate the conduit bearing capacity reinforcing device, to achieve to increase an effective action area between the riser or the surface conduit and the seabed soil, thereby increasing the bearing capacity of the conduit, so as to ensure safety and efficiency of field exploration and development operations.

Specifically, the outer cylinder 1 is substantially cylindrical and is made of a metal material, an upper end of the outer cylinder 1 is provided with a female buckle 15 through which the outer cylinder 1 can be sealingly connected to other tubular columns, to send the inner start-up tool to a certain depth position in the downhole; a lower end of the outer cylinder 1 is plugged with a rotating plug 16 which is made of a rubber material, or of course of other materials, and this is not limited here. The rotating plug 16 is mainly used for preliminarily sealing the outer cylinder 1 to prevent parts inside the outer cylinder 1 from falling out into the well, causing unnecessary influence on subsequent operations. The rotating plug 16 can be sealingly connected to the outer cylinder 1 in a threaded manner.

In the present invention, a plurality of liquid flow holes 18 are provided at intervals in a circumferential direction on the upper cylinder wall of the outer cylinder 1, and the pressure bearing disc 11 can block the plurality of liquid flow holes 18. The liquid flow holes 18 are provided at the cylinder wall of the outer cylinder 1 at a depth at which the pressure bearing disc 11 is initially located. The liquid flow holes 18 communicate with an inner cavity of the outer cylinder 1. In normally unpressurized conditions, these liquid flow holes 18 are just shielded by the pressure bearing disc 11, and when the pressure bearing disc 11 is pressed downward, these liquid flow holes 18 are exposed, and fluid in the outer cylinder 1 can flow out through the liquid flow holes 18.

Further, two side openings 19 are disposed symmetrically radially on the lower cylinder wall of the outer cylinder 1, the two side openings 19 communicate with the inner cavity of the outer cylinder 1, and the first ring block 13 and the second ring block 14 respectively pass through the corresponding side openings 19. The two side openings 19 are shaped and dimensioned to conform to the first ring block 13 and the second ring block 14, respectively, or the two side openings 19 are dimensioned to be slightly larger than the first ring block 13 and the second ring block 14. When the pressure bearing disc 11 is pressed to move downward, a plurality of liquid flow holes 18 at an upper portion of the outer cylinder 1 are exposed, and in this state, the first ring block 13 and the second ring block 14 may respectively extend out from the two side openings 19 and may not extend completely beyond the outer cylinder 1, that is, in a state that the first ring block 13 and the second ring block 14 extend out, an end of the first ring block 13 and an end of the second ring block 14 are also located in the two side openings 19 of the outer cylinder 1 to ensure smooth retraction of the first ring block 13 and the second ring block 14.

The pressure bearing disc 11 is substantially in the shape of a flat cylinder having a small thickness, and can be made of a rubber material or a metal material. When being pressed, the pressure bearing disc 11 can move downward a certain distance along the axis of the outer cylinder 1. In this embodiment, an outer diameter of the pressure bearing disc 11 coincides with an inner diameter of the outer cylinder 1, and is axially movable and is movably sealed in the outer cylinder 11. For example, a plurality of protrusion blocks are provided on the outer wall of the pressure bearing disc 11, a plurality of axial grooves are provided on an inner wall of the outer cylinder 1. The protrusion blocks are inserted into the axial grooves and are slidable in the axial grooves. Of course, the present invention is not limited to this structure as long as it can be ensured that the pressure bearing disc 11 can axially and sealingly move relative to the outer cylinder 1.

The balance block 12 is made of a metal material, can be disc-shaped or cuboid-shaped, and has an outer diameter smaller than that of the pressure bearing disc 11. The balance block 12 can be elastically connected to a lower end of the pressure bearing disc 11. In this embodiment, a compression spring 17 is connected between the balance block 12 and the pressure bearing disc 11. The compression spring 17 is made of a metal material and is fixedly connected at central positions of a lower end face of the pressure bearing disc 11 and of an upper end face of the balance block 12. When the pressure bearing disc 11 is pressed to move downward, the compression spring 17 is compressed and then moved downward. After the pressure exerted on the pressure bearing disc 11 is unloaded, the compression spring 17 restores its original shape under the action of an elastic potential energy and moves upward along the axis of the outer cylinder 1.

Figure 2:
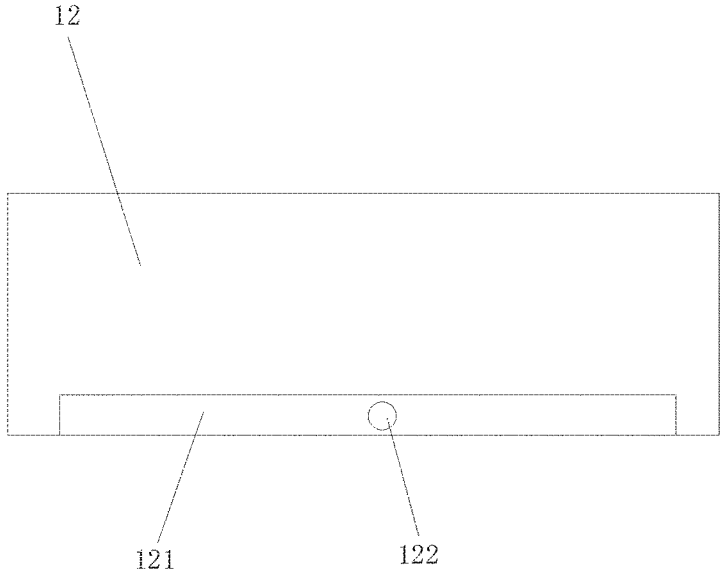
FIG. 2 is a structural schematic front view of a balance block according to the present invention.
Figure 3:
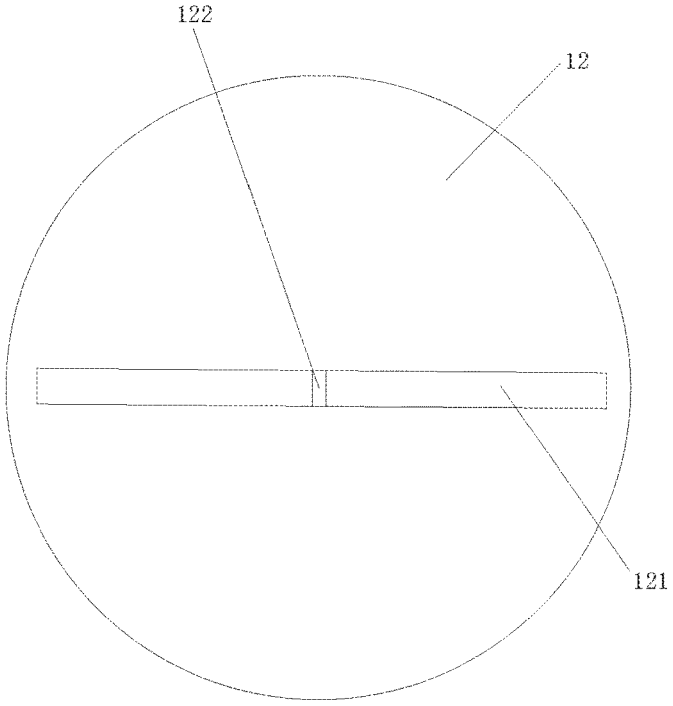
FIG. 3 is a structural schematic bottom view of a balance block according to the present invention.

Further, in the present invention, as shown in FIGS. 2 and 3, a radial groove 121 is disposed at a central part of the lower end face of the balance block 12, and a top pin shaft 122 is connected at a middle portion of the radial groove 121.

The first vertical rod 21 and the first horizontal rod 22 of the first link mechanism 2 are rotatably connected by a pin shaft 23, and the first horizontal rod 22 is disposed rotatably about the pin shaft 23 connected between the first horizontal rod 21 and the first vertical rod 21. The upper end of the first vertical rod 21 is movably connected in the radial groove 121 of the lower end face of the balance block 12 through the top pin shaft 122. The first vertical rod 21 is rotatable about the top pin shaft 122 in the radial groove 121 in an extension direction of the radial groove 121 so as to be rotatably connected to the balance block 12. The end of the first horizontal rod 22 is rotatably connected onto the first ring block 13 via a pin shaft 24.

Figure 4:
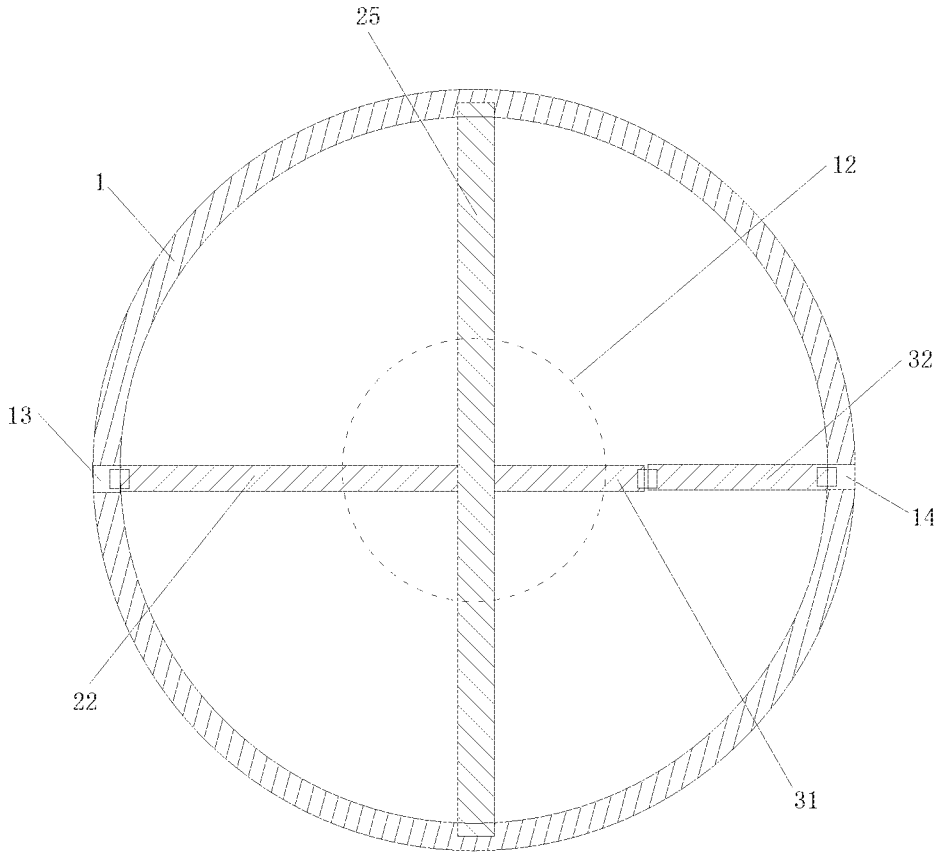
FIG. 4 is a cross-sectional schematic of an inner start-up tool of a conduit bearing capacity reinforcing device according to the present invention.

In this embodiment, as shown in FIG. 4, a horizontal central shaft 25 is inserted in the middle portion of the first vertical rod 21, and both ends of the horizontal central shaft 25 are fixedly connected onto the cylinder wall of the outer cylinder 1, respectively, and the horizontal central shaft 25 is disposed perpendicularly to the first vertical rod 21. The first vertical rod 21 is fixed to the outer cylinder 1 at its axial center position by the horizontal central shaft 25, and the first vertical rod 21 is rotatable about the horizontal central shaft 25, which is a circular metal rod.

The second vertical rod 31 and the second horizontal rod 32 of the second link mechanism 3 are rotatably connected by a pin shaft 33, and the second horizontal rod 32 is disposed rotatably about the pin shaft 33 connected between the second horizontal rod 32 and the second vertical rod 31. The upper end of the second vertical rod 31 is movably connected in the radial groove 121 of the lower end face of the balance block 12 through the top pin shaft 122. The second vertical rod 31 is rotatable about the top pin shaft 122 in the radial groove 121 in an extension direction of the radial groove 121 so as to be rotatably connected to the balance block 12. The end of the second horizontal rod 32 is rotatably connected onto the first ring block 14 via a pin shaft 34.

In the present invention, the first link mechanism 2 and the second link mechanism 3 coincide with the radial groove 121 on the balance block 12 as viewed from the top of the inner start-up tool.

Figure 5:
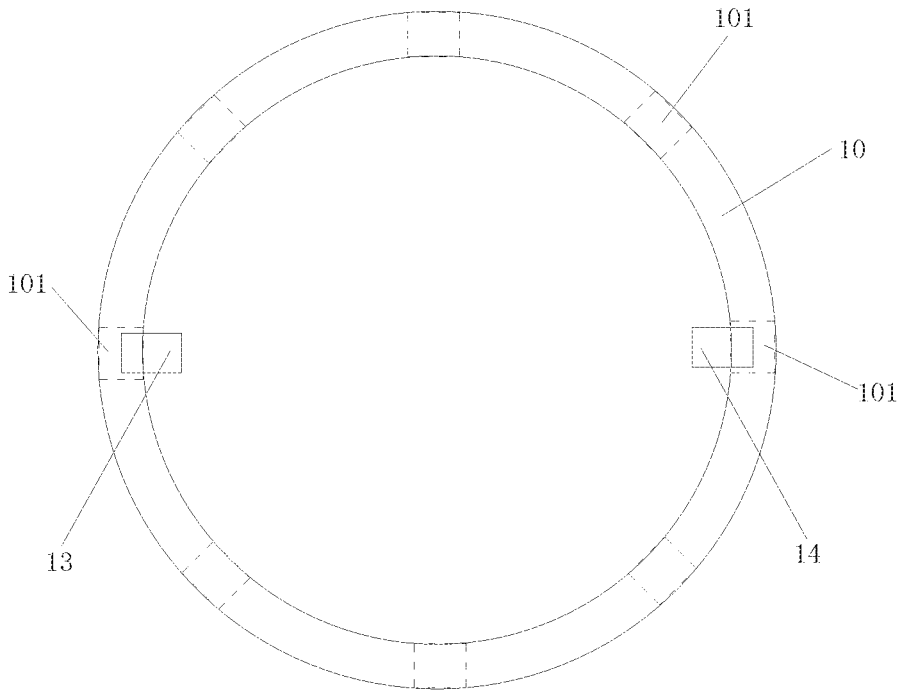
FIG. 5 is a structural schematic illustrating that a first ring block and a second ring block of the inner start-up tool of the conduit bearing capacity reinforcing device are respectively clamped on a circular ring of the conduit bearing capacity reinforcing device according to the present invention.

The working process of the inner start-up tool of the conduit bearing capacity reinforcing device is as follows:

When seawater or other fluid is continuously injected into the outer cylinder 1, the pressure bearing disc 11 in the outer cylinder 1 descends under the action of liquid column pressure and compresses the compression spring 17 until the compression spring 17 descends together with the balance block 12. At this time, the first vertical rod 21 rotates clockwise about the horizontal central shaft 25, the upper end of the first vertical rod 21 and the upper end of the second vertical rod 31 descend together with the balance block 12. The first horizontal rod 22 and the first ring block 13 move together with the lower end of the first vertical rod 21 towards one side of the outer cylinder 1 until the first ring block 13 extends out of the outer cylinder 1 and is clamped in the reserved keyways 101 on the circular ring 10 of the conduit bearing capacity reinforcing device. As shown in FIG. 5, the second horizontal rod 32 and the second ring block 14 move together with the lower end of the second vertical rod 31 towards the other side of the outer cylinder 1 until the second ring block 14 extends out of the outer cylinder 1 and is clamped in the reserved keyways 101 on the circular ring 10 of the conduit bearing capacity reinforcing device. When the second ring block 14 and the first ring block 13 are both clamped in position, the inner start-up tool is rotated by about 30 degrees, at this time the circular ring 10 of the conduit bearing capacity reinforcing device is rotated by about 30 degrees. The sector plate of the conduit bearing capacity reinforcing device is in a state of completely shielding circular holes or the circular holes are completely open. After the corresponding operation of the conduit column tool is completed, the pump is turned off to stop the circulation, the seawater is stopped to be pumped into the conduit column, fluid in the conduit column and the inner start-up tool will be discharged along a plurality of liquid flow holes 18. When the liquid column pressure in the outer cylinder 1 is lower than the elastic potential energy of the compression spring 17, the compression spring 17 will restore its original shape and drive the balance block 12, the first link mechanism 2 and the second link mechanism 3 to ascend together. The first ring block 13 and the second ring block 14, together with the first horizontal rod 22 and the second horizontal rod 32, will also be retreated to the inside of the side openings 19, thereafter the conduit column can be lifted and the inner start-up tool of the present invention can be recovered.

The inner start-up tool of the conduit bearing capacity reinforcing device according to the invention can be repeatedly use for many times, is simple in structure, is low in cost and is easy to use; in addition, the inner start-up tool is convenient to operate, has high reliability, can be lowered and lifted rapidly and conveniently, without difficulty in being lowered or lifted.

Embodiment 2

As shown in FIGS. 1 to 5, the present invention also provides a using method of an inner start-up tool, which adopts the inner start-up tool of the conduit bearing capacity reinforcing device as described in the first embodiment. The structure, working principle and beneficial effects of the inner start-up tool of the conduit bearing capacity reinforcing device have been described in the first embodiment and will not be repeated here. The using method of the inner start-up tool comprises the following steps:

a step S1 of seating the inner start-up tool of the conduit bearing capacity reinforcing device on a platform surface and connecting the inner start-up tool to a drilling column to form a tool string;

a step S2 of lowering the tool string to a designed depth, thereafter opening pump circulation to fill the tool string with seawater, wherein under the pressure of the seawater, the pressure bearing disc 11 moves downwards, the first ring block 13 and the second ring block 14 extend radially outward from the outer cylinder 1 under the action of the first link mechanism 2 and the second link mechanism 3;

a step S3 of lifting or rotating the tool string such that the first ring block 13 and the second ring block 14 of the tool string are aligned with a plurality of keyways 101 on a circular ring 10 of the conduit bearing capacity reinforcing device; and a step S4 of gently lifting or lowering the drill column, and if the lifting or lowering is obstructed, it can be confirmed that the inner start-up tool of the conduit bearing capacity reinforcing device has been mated with the conduit bearing capacity reinforcing device, otherwise, continuing to fine-tune a position of the inner start-up tool of the conduit bearing capacity reinforcing device until the inner start-up tool of the conduit bearing capacity reinforcing device is successfully mated with the conduit bearing capacity reinforcing device.

Before the step S1, it is necessary to adjust the inner start-up tool of the conduit bearing capacity reinforcing device, and specifically, the rotating plug 16 is tightened to avoid falling off, the pressure bearing disc 11 is pressed down to ensure that the first ring block 13 and the second ring block 14 are able to extend out smoothly, the pressure bearing disc 11 is released to ensure that the first ring block 13 and the second ring block 14 can be recovered smoothly.

In the step S1, before the inner start-up tool is connected to the drilling column, the female buckle 15 on the outer cylinder 1 needs to be cleaned and coated with thread screw oil.

After the step S4, the tool string is rotated clockwise by about 30 degrees, the pump is turned off to stop circulation and is reseted for a certain period of time; the tool string is then lifted, the inner start-up tool is recovered, the rotating plug 16 is loosened, the seawater remaining in the inner start-up tool is released and the inner start-up tool is cleaned.

The using method of the inner start-up tool of the present invention is convenient to operate and has high reliability, can be lowered and lifted rapidly and conveniently, without difficulty in being lowered or lifted.

Those described above are just several embodiments of the present disclosure. A person skilled in the art can make various changes or modifications to the embodiments of the present invention according to the content disclosed by the application document, without deviating from the spirit or scope of the present invention.

The invention claimed is:

1. A start-up tool comprising:

an outer cylinder in which a pressure bearing disc is axially movably provided, a lower end of the pressure bearing disc being elastically connected with a balance block, and a first ring block and a second ring block being movably diametrically disposed through a lower cylinder wall of the outer cylinder;

a first link mechanism having a first vertical rod and a first horizontal rod rotatably connected to the first vertical rod, the first vertical rod being rotatably connected to the balance block, the first horizontal rod being rotatably connected to the first ring block; and a second link mechanism having a second vertical rod and a second horizontal rod rotatably connected to the second vertical rod, the second vertical rod being rotatably connected to the balance block, the second horizontal rod being rotatably connected to the second ring block.

2. The start-up tool according to claim 1, wherein a plurality of liquid flow holes are provided at intervals in a circumferential direction on an upper cylinder wall of the outer cylinder, and the pressure bearing disc can block the plurality of liquid flow holes.

3. The start-up tool according to claim 1, wherein a compression spring is connected between the pressure bearing disc and the balance block.

4. The start-up tool according to claim 1, wherein a horizontal central shaft is inserted in a middle portion of the first vertical rod, both ends of the horizontal central shaft are fixedly connected onto the cylinder wall of the outer cylinder, respectively, and the horizontal central shaft is disposed perpendicularly to the first vertical rod.

5. The start-up tool according to claim 1, wherein a radial groove is disposed on a lower end face of the balance block, an upper end of the first vertical rod and an upper end of the second vertical rod are both rotatably connected within the radial groove by a top pin shaft.

6. The start-up tool according to claim 1, wherein a lower part of the outer cylinder is plugged with a rotating plug.

7. The start-up tool according to claim 1, wherein an upper end of the outer cylinder is provided with a female buckle.

8. The start-up tool according to claim 1, wherein in a state that the pressure bearing disc presses down the balance block, the first ring block and the second ring block can extend out of the cylinder wall of the outer cylinder.

* * * * *